United States Patent [19]

Stivender

[11] 4,237,830

[45] Dec. 9, 1980

[54] VEHICLE ENGINE AIR AND FUEL MIXTURE CONTROLLER WITH ENGINE OVERRUN CONTROL

[75] Inventor: Donald L. Stivender, Bloomfield Hills, Mich.

[73] Assignee: General Motors Corporation, Detroit, Mich.

[21] Appl. No.: 952,490

[22] Filed: Oct. 18, 1978

[51] Int. Cl.[3] ..... F02D 35/00; F02P 5/04

[52] U.S. Cl. ..... 123/493; 123/437; 123/434 123/32 EE; 123/119 EC

[58] Field of Search ..... 123/32 EL, 32 EA, 32 EE, 123/119 EC; 60/276, 285

[56] References Cited

U.S. PATENT DOCUMENTS

| | | | |
|---|---|---|---|
| 4,062,328 | 12/1977 | Konno | 123/32 EL |
| 4,094,274 | 6/1978 | Harada et al. | 123/32 EL |
| 4,108,127 | 8/1978 | Chapin et al. | 123/119 EC |
| 4,126,107 | 11/1978 | Harada et al. | 123/32 EL |
| 4,127,086 | 11/1978 | Harada et al. | 123/32 EL |
| 4,133,326 | 1/1979 | Gaps et al. | 123/119 EC |
| 4,138,979 | 2/1979 | Taplin | 123/119 EC |
| 4,146,000 | 3/1979 | Hattori et al. | 123/32 EL |
| 4,168,679 | 9/1979 | Ikeura et al. | 123/32 EE |

FOREIGN PATENT DOCUMENTS

| | | | |
|---|---|---|---|
| 2420032 | 11/1975 | Fed. Rep. of Germany | 123/32 EL |

*Primary Examiner*—Charles J. Myhre
*Assistant Examiner*—R. A. Nelli
*Attorney, Agent, or Firm*—Howard N. Conkey

[57] ABSTRACT

An engine air and fuel controller for a vehicle internal combustion engine is described wherein the mass fuel flow rate is controlled directly in response to vehicle operater command. The engine throttle is positioned by an electronic controller in response to the fuel flow rate to achieve a mass air flow rate determined to produce a scheduled air/fuel ratio. The controller includes a circuit which is responsive to the engine speed to limit the minimum value of the commanded fuel flow rate in accord with a predetermined schedule at a rate whereat the engine throttle is controlled to a scheduled open position during engine overrun conditions to improve engine operation.

2 Claims, 3 Drawing Figures

VEHICLE ENGINE AIR AND FUEL MIXTURE CONTROLLER WITH ENGINE OVERRUN CONTROL

This invention relates to an air and fuel mixture controller for a vehicle internal combustion engine.

In one form of air and fuel regulator for vehicle engines, the vehicle operator directly controls the mass air flow into the engine by manually adjusting a throttle in the air flow path and the fuel metering system senses the air flow and meters fuel to the engine at a rate to produce a desired air/fuel ratio. In these systems, air flow is the forcing function.

In another form of air and fuel regulator, the forcing function is the mass fuel flow rate. In this type of system, the fuel flow is directly adjusted by the vehicle operator and the throttle in the air flow path is adjusted in response to the fuel flow rate to provide for a desired air/fuel ratio.

In each of the foregoing air and fuel regulators, during engine overrun where the throttle is closed at high engine speeds, incomplete combustion conditions occur resulting in high emissions of unburned hydrocarbons. A number of solutions have been proposed to improve the combustion conditions in air and fuel regulators in which the air flow is the forcing function. These solutions include throttle crackers, throttle return check valves, and dashpots all of which generally prevent the throttle from being closed during the overrun condition. While these solutions may result in improving the combustion conditions in systems wherein the air flow is the forcing function, they are generally inapplicable to systems in which fuel flow is the forcing function. For example, a throttle cracker in a system where fuel flow is the forcing function would result in the air/fuel ratio of the mixture supplied to the engine deviating from the desired value.

It is one object of this invention to provide for an improvement in the combustion conditions during engine overrun conditions in a vehicle internal combustion engine air and fuel regulator in which fuel flow is the forcing function.

It is another object of this invention to limit the minimum value of the fueling function in an air and fuel controller in which fuel is the forcing function to a value resulting in a mass air flow into the engine that is greater than the minimum possible mass air flow to provide for improved combustion conditions during engine overrun.

The invention may be best understood by reference to the following description of a preferred embodiment and the drawings, in which.

Figure 1:
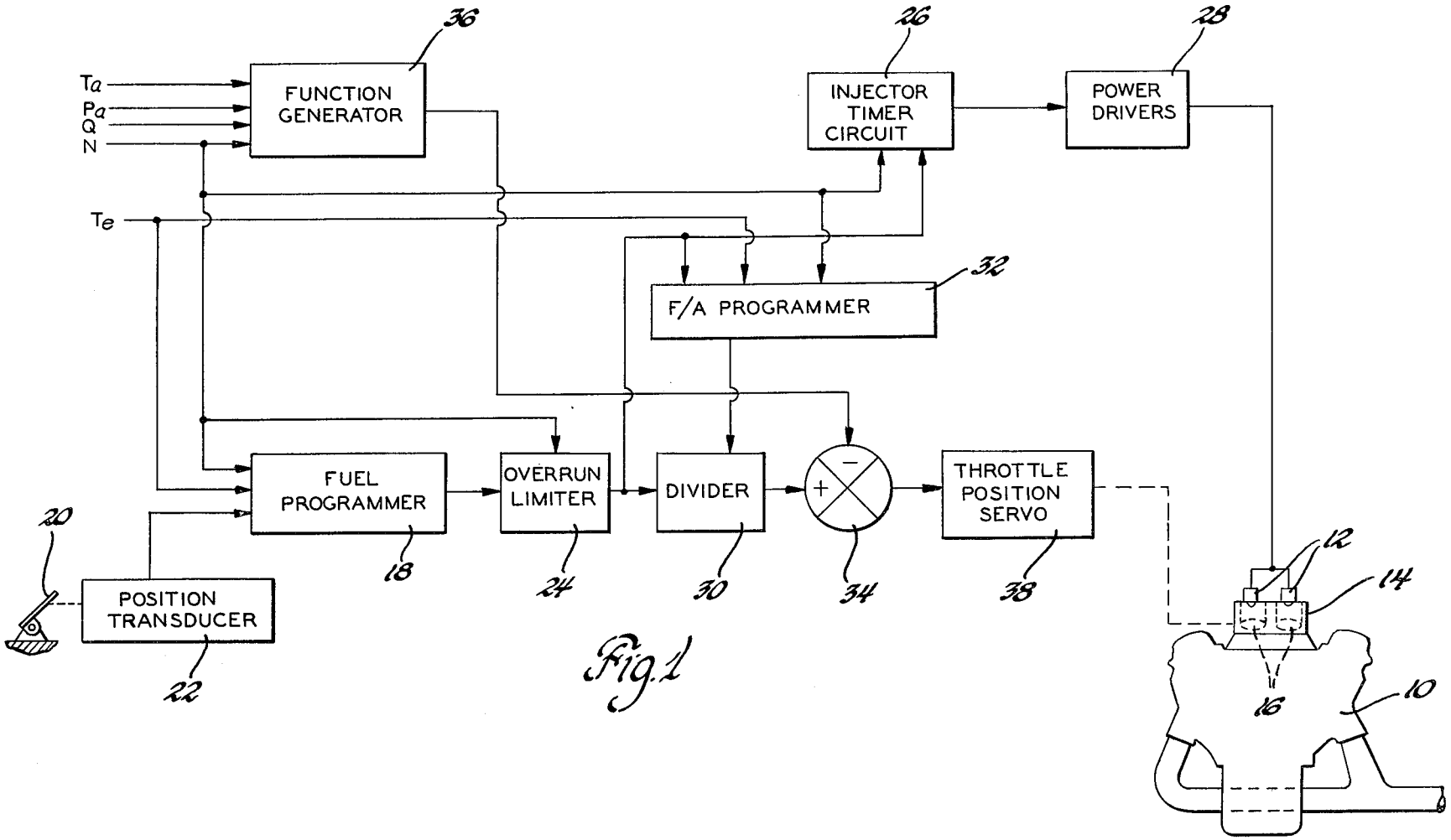
FIG. 1 is a diagram of a preferred embodiment of a vehicle engine air and fuel controller incorporating the principles of this invention.

Referring to FIG. 1, an air and fuel controller incorporating the principles of this invention is illustrated. Fuel is supplied to the intake manifold of an internal combustion engine 10 in this embodiment by means of a pair of electromagnetically actuated fuel injectors 12 that are mounted above a throttle body 14 and that are supplied with fuel under regulated pressure by conventional means. The mass fuel flow rate is determined by the controlled timed energization of the fuel injectors 12. The fuel is mixed with air drawn into the intake manifold during engine operation through the throttle bores of the throttle body 14 with the mass air flow rate being controlled by the angular position of a pair of throttle blades 16 positioned in the throttle bores. The air and fuel supplied to the intake manifold through the throttle body 14 form a combustible mixture that is drawn into the cylinders of the engine 10 to undergo combustion.

The fuel flow to the intake manifold of the engine 10 is controlled by a fuel programmer 18 which is responsive to signals representing the engine coolant temperature $T_e$, engine speed N and a vehicle operator command signal. The vehicle operator command signal has a value that is proportional to the position of a conventional vehicle accelerator pedal 20 and which represents an operator commanded mass fuel flow rate. The position of the accelerator pedal 20 is monitored by a position transducer 22 whose output is the operator command signal. The apparatus producing the signals representative of the accelerator position, engine coolant temperature and engine speed may take the form of any of the well known position, speed and temperature transducers each of which provides an output having a magnitude representing the respective parameter.

The output of the fuel programmer 18 is a signal representing a commanded mass fuel flow per engine revolution and having a value $W_f/N$ where $W_f$ is mass fuel flow and N is engine speed. The value $W_f/N$ is primarily controlled by the vehicle operator via the accelerator pedal 20 and represents the forcing function of the control system of this invention.

The output of the fuel programmer 18 is coupled to the input of an overrun limiter 24 which is responsive to engine speed N to limit the lower value of the commanded fuel flow per engine revolution in accord with a predetermined schedule independent of the operator commanded fuel flow so as to improve engine operation during engine overrun conditions. The commanded fuel flow per engine revolution as limited by the limiter 24 is coupled to an injector timer circuit 26 which also receives the engine speed signal N. The injector timer circuit 26 provides timed injection pulses at a frequency according to engine speed and having durations determined by the magnitude $W_f/N$ of the output signal of the limiter 24. The injection pulses are coupled to injector drivers 28 whose output functions to energize the electromagnetic fuel injectors 12 to supply fuel to the engine 10. The mass of fuel injected into the engine during each revolution is equal to the value $W_f/N$ having the lower limit determined by the limiter 24 in accord with engine speed.

The mass flow rate of the air drawn into the engine 10 through the throttle body 14 is controlled in response to the commanded mass fuel flow respresented by the value $W_f/N$ at the output of the limiter 24 by adjusting the position of the throttle blades 16 until the mass air flow rate has a value resulting in a desired air/fuel ratio.

The output of the limiter 24 is coupled to one input of a divider 30 which divides the commanded mass fuel flow by a scheduled fuel/air ratio provided by a fuel/air programmer 32. The fuel/air programmer 32 is responsive to engine speed N, engine coolant temperature $T_e$ and the commanded engine load represented by the output of the limiter 24 to provide an output signal having a value representing a scheduled fuel/air ratio in accord with a pre-programmed schedule.

The output of the divider 30 is a signal representing a commanded mass air flow per engine revolution and which has the value $(W_a/N)_d$ where $W_a$ is mass air flow and N is engine speed. The value of $(W_a/N)_d$ and engine speed N defines a commanded mass air flow rate. The commanded mass air flow rate is coupled to the positive input of a summer 34 which compares it to a measured actual value $(W_a/N)_a$ of the mass air flow per engine revolution.

In the preferred embodiment, the actual mass air flow per engine revolution is determined in response to signals representing the volume of air flow Q into the engine 10, the engine intake air temperature $T_a$, the engine intake air pressure $P_a$ and engine speed N. The actual mass air flow per engine revolution is determined by a function generator 36 which supplies the signal representing the actual mass air flow per engine revolution to the negative input of the summer 34 as determined by the expression $K_1((QP_a)/(NT_a))$, where $K_1$ is a constant. The signal output of the summer 34 represents the error between the commanded mass air flow per engine revolution and the actual measured mass air flow per engine revolution.

The signals representing the intake air temperature, intake air pressure and volume air flow are provided by any of the well known transducers which are responsive to and which provide signals having values related to the respective parameters.

The output of the summer 34 is coupled to a throttle position servo 38 whose output positions the throttle blades 16 to a position producing the commanded mass air flow per revolution. The throttle position servo 38 may take the form of a reversible DC motor whose output shaft positions the throttle blades 16 and further may include a position feedback transducer for providing a closed loop positioning of the DC motor output shaft such as illustrated in copending application Ser. No. 868,479 filed on Jan. 11, 1978 and which is assigned to the assignee of the present invention.

If during deceleration and coast conditions the throttle blades were closed in an attempt to achieve the commanded mass air flow per engine revolution resulting from a low value of the commanded fuel flow per revolution, undesirable engine operation may result. For example, incomplete combustion conditions may be produced resulting in increased emissions of unburned hydrocarbons. To alleviate the undesirable engine operating conditions during engine overrun, the minimum value of the commanded mass fuel flow per engine revolution at the output of the fuel programmer 18 is limited by the overrun limiter 24 in accord with engine speed to a value resulting in a commanded mass air flow per engine revolution at the output of the divider 30 that is greater than the minimum mass air flow achievable at closed throttle conditions. In this manner, the throttle blades 16 are maintained in a partly open position so that the low air flow and high vacuum conditions producing the undesirable engine operating characteristics during engine overrun are substantially eliminated.

Figure 3:
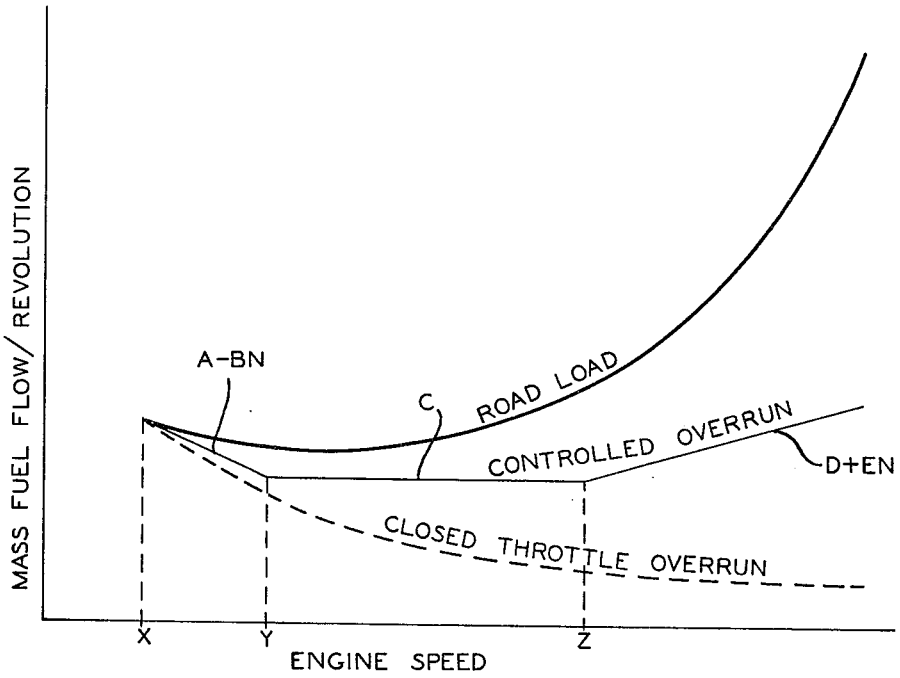
FIG. 3 is a graph illustrating the principles of this invention.

Referring to FIG. 3, there is illustrated three curves of scheduled fuel flow per engine revolution as a function of engine speed. The road load curve illustrates the mass fuel flow per engine revolution required to maintain the engine speed at the scheduled air/fuel ratio. The closed throttle overrun curve is representative of the fueling function resulting in closed throttle during engine deceleration or coast. The combustion conditions resulting from the fueling function illustrated in the closed throttle curve produces the aforementioned undesirable engine operating conditions.

In accord with this invention, the minimum value of the commanded mass fuel flow per engine revolution for a given engine speed is limited as illustrated by the controlled overrun curve of FIG. 3. This predetermined schedule of minimum fuel flow as a function of engine speed is determined to produce adequate engine braking during engine overrun while yet maintaining the throttle in a partly open position to assure satisfactory engine operation including engine combustion conditions.

Figure 2:
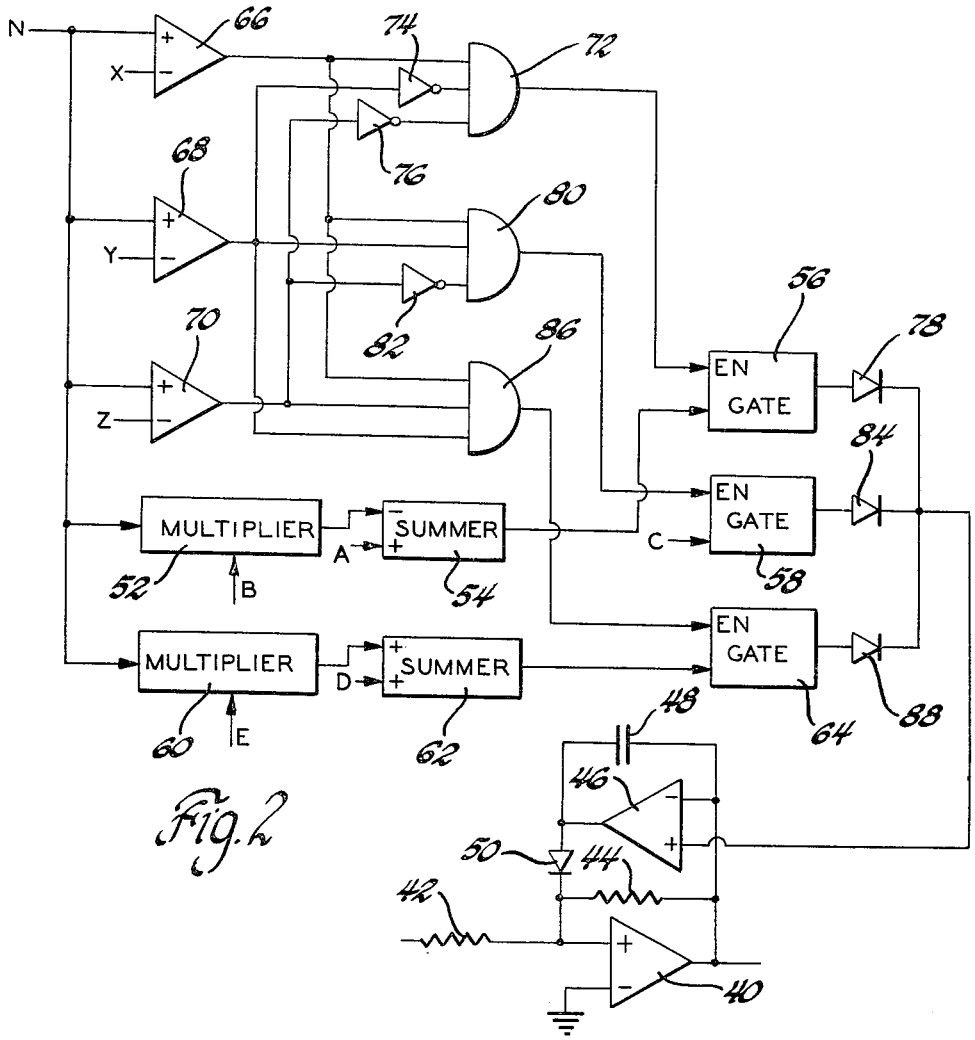
FIG. 2 is a diagram of the overrun limiter of FIG. 1 for limiting the minimum value of the fueling function in accord with engine speed.

FIG. 2 is illustrative of a circuit for limiting the minimum value of the output of the fuel programmer 32 in accord with the predetermined schedule such as illustrated in the controlled overrun curve of FIG. 3. Referring to FIG. 2, the signal output of the fuel programmer 32 having a value representing the commanded mass fuel flow per engine revolution is applied to the positive input of an amplifier 40 through a resistor 42. The negative input of the amplifier 40 is grounded. A feedback resistor 44 is provided having a value relative to the resistor 42 producing unity gain in the amplifier 40. The output of the amplifier 40 representing commanded mass fuel flow per engine revolution limited in accord with this invention is coupled to the divider 30 of FIG. 1 and also to the negative input of a limiter amplifier 46.

A feedback capacitor 48 is coupled between the output and negative input of the amplifier 46 thereby producing an integrator whose output is coupled to the positive input of the amplifier 40 through a diode 50. A reference voltage generated in the manner to be described is applied to the positive input of the amplifier 46 and represents the minimum value of the fuel flow per revolution allowed at the output of the amplifier 40. When the output of the amplifier 40 becomes less than the reference value provided to the positive input of the amplifier 46, the output of the amplifier 46 increases to supply a signal to the positive input of the amplifier 40 through the diode 50. Since the amplifier 46 with capacitor 48 functions as an integrator, the output of the amplifier 46 increases until the output of the amplifier 40 is equal to the reference signal. At that time, the output of the amplifier 46 and the commanded fuel flow per revolution represented by the output of the amplifier 40 remain constant. For increasing values of the commanded fuel flow per engine revolution from the programmer 18, the output of the amplifier 40 increases in the same amount uncontrolled by the amplifier 46 whose output is reduced to its negative saturation value. Consequently, the limiter provided by the amplifier 46 is operative to limit the minimum value of the commanded mass fuel flow per engine revolution only when the commanded mass fuel flow per engine revolution decreases below the reference value provided to its positive input.

The reference value provided to the positive input of the amplifier 46 is generated in accord with the schedule represented by the controlled overrun curve of FIG. 3. As seen in FIG. 3, the controlled overrun curve takes the form of three straight line segments. For engine speeds between X and Y, the curve may be represented by the expression $A-BN$ where A and B are constants determined by the intercept and slope of the curve segment. Between engine speeds Y and Z, the curve is equal to a constant value C. For engine speeds greater than Z, the curve is represented by the expression D+EN where D and E are constants determined by the intercept and slope of the curve segment.

The curve segment between the engine speeds X and Y is generated by a multiplier 52 which multiplies the instantaneous engine speed N with the constant B and a summer 54 which subtracts the product from the constant A. The output of the adder 54 represents the curve segment between the engine speeds X and Y and is coupled to the input of a normally closed gate 56. A signal having the constant value C of the segment of the curve between speeds Y and Z is provided to the input of a normally closed gate 58. The curve segment for engine speeds greater than Z is provided by means of a multiplier 60 which multiplies the instantaneous value of engine speed N with the constant E and a summer 62 which adds the product to the constant D. The output of the adder 62 represents the curve segment at engine speeds greater than Z and is coupled to a normally closed gate 64.

The gates 56, 58 and 64 are selectively enabled to couple their respective inputs to the positive input of the amplifier 46 as a function of the speed range of the engine.

Comparator switches 66, 68 and 70 compare the instantaneous engine speed with the engine speed values X, Y and Z respectively. When the engine speed is greater than X but less than Y, the output of the comparator switch 66 is a high value and the outputs of the comparator switches 68 and 70 are low values. When the engine speed is greater than Y but less than Z, the outputs of the comparator switches 66 and 68 are high and the output of the comparator switch 70 is low. When the engine speed is greater than the value Z, the outputs of all three of the comparator switches 66 through 70 are high values. An AND gate 72 is responsive to the output of the comparator switch 66 and the inverted outputs of the comparator switches 68 and 70 from a pair of inverters 74 and 76 to provide a high output to enable the gate 56 only when the engine speed is between the values X and Y. In this speed range, the gate 56 is enabled to apply the output of the adder 54 representing the straight line segment between the speed values X and Y of FIG. 3 to the reference input of the amplifier 46 through a diode 78. In this speed range, the minimum value of the commanded mass fuel flow per engine revolution output of the fuel programmer 18 of FIG. 1 is limited according to the predetermined schedule illustrated in FIG. 3.

When the engine speed is between the values Y and Z, an AND gate 80 is responsive to the outputs of the comparator switches 66 and 68 and the inverted output of the comparator switch 70 from an inverter 82 to provide a high signal to enable the gate 58 to apply the constant value C to the reference input of the amplifier 46 through a diode 84. Consequently, when the engine speed is between the values Y and Z, the output of the fuel programmer 18 is limited to the value C in accord with the predetermined schedule illustrated in FIG. 3.

When the engine speed is greater than the value Z, the AND gate 86 is responsive to the outputs of the comparator switches 66 through 70 to enable the gate 64 to supply the output of the adder 62 to the positive input of the amplifier 46 through a diode 88. Accordingly, when the engine speed is greater than Z, the minimum value of the commanded mass fuel flow per engine revolution at the output of the fuel programmer 18 is limited in accord with the curve of FIG. 3.

In the foregoing manner, the minimum value of the commanded fuel flow per engine revolution is limited as a function of engine speed in accord with the predetermined schedule illustrated in the controlled overrun curve of FIG. 3 so as to control the throttle blades 16 to a scheduled open position during engine overrun to thereby improve engine operation during engine overrun conditions.

The foregoing description of the preferred embodiment of the invention for the purposes of illustrating the invention is not to be considered as limiting or restricting the invention as many modifications may be made by the exercise of one skilled in the art.

The embodiments of the invention in which an exclusive property or privilege is claimed are defined as follows:

1. An air and fuel mixture control apparatus for a motor vehicle internal combustion engine having an intake space into which air and fuel are supplied, comprising in combination:

an engine fuel supply means effective to supply fuel to the engine intake space at a vehicle operator controlled fuel flow rate;

an engine air supply means including a throttle operable between wide open and closed positions to regulate the air flow rate into the engine intake space, the throttle closed position defining a minimum available air flow rate into the engine and a maximum vacuum in the intake space;

means responsive to the fuel flow rate effective to provide an engine air flow rate signal representing the air flow rate required to produce a predetermined air/fuel ratio;

means effective to monitor the actual air flow rate into the engine;

air control means responsive to the air flow rate signal and the monitored air flow rate effective to position the throttle to a position at which the actual air flow rate is substantially equal to the air flow rate represented by the air flow rate signal;

means effective to sense engine speed; and means responsive to the sensed engine speed effective to limit the minimum value of the fuel flow rate independent of the vehicle operator controlled fuel flow rate in accord with the value of engine speed to a fuel flow rate whereat the engine air flow rate represented by the air flow rate signal is greater than the minimum available air flow rate, the throttle position being limited in the closed direction by the air control means in accord with the limited minimum value of the fuel flow rate to maintain the vacuum in the intake space at a value less than the maximum value to provide improved engine operation during engine deceleration and coast conditions.

2. An air and fuel mixture control apparatus for a motor vehicle internal combustion engine having an intake space into which air and fuel are supplied, comprising in combination:

an engine fuel supply means effective to supply fuel to the engine intake space at a vehicle operator controlled fuel flow rate;

an engine air supply means including a throttle operable between wide open and closed positions to regulate the air flow rate into the engine intake space, the throttle closed position defining a minimum available air flow rate into the engine and a maximum vacuum in the intake space;

air control means responsive to the fuel flow rate effective to position the throttle to a position at which the air flow rate produces a predetermined air/fuel ratio;

means effective to sense engine speed; and means effective to limit the minimum value of the fuel flow rate independent of the vehicle operator controlled fuel flow rate in accord with a predetermined schedule to a fuel flow rate whereat the air flow rate producing the predetermined air/fuel ratio is greater than the minimum available air flow rate, the throttle position being limited in the closed direction by the air control means in accord with the limited minimum value of the fuel flow rate to maintain the vacuum in the intake space at a value less than the maximum value to provide improved engine operation during engine overrun conditions.

* * * * *